US008525821B2

(12) United States Patent
Takahashi

(10) Patent No.: US 8,525,821 B2
(45) Date of Patent: Sep. 3, 2013

(54) DISPLAY DRIVING DEVICE, SEMICONDUCTOR DEVICE AND LIQUID CRYSTAL DISPLAY APPARATUS

(75) Inventor: Katsuyoshi Takahashi, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 980 days.

(21) Appl. No.: 12/511,553

(22) Filed: Jul. 29, 2009

(65) Prior Publication Data

US 2010/0033466 A1 Feb. 11, 2010

(30) Foreign Application Priority Data

Aug. 5, 2008 (JP) ..... 2008-201441

(51) Int. Cl.
*G09G 5/00* (2006.01)

(52) U.S. Cl.
USPC ..... 345/211; 327/157

(58) Field of Classification Search
USPC ..... 345/45, 92, 98, 100; 341/139, 144; 330/255, 257
See application file for complete search history.

(56) References Cited

U.S. PATENT DOCUMENTS

| | | | | |
|---|---|---|---|---|
| 7,355,575 | B1 * | 4/2008 | Ota et al. | 345/87 |
| 2002/0008799 | A1 * | 1/2002 | Ota et al. | 349/43 |
| 2002/0022938 | A1 * | 2/2002 | Butler | 702/85 |
| 2002/0175904 | A1 * | 11/2002 | Matsumoto | 345/204 |
| 2005/0068105 | A1 * | 3/2005 | Shimatani | 330/255 |
| 2007/0159250 | A1 * | 7/2007 | Tsuchi et al. | 330/253 |
| 2008/0309386 | A1 * | 12/2008 | Vlasenko | 327/157 |

FOREIGN PATENT DOCUMENTS

| | | | |
|---|---|---|---|
| JP | 2004-029409 | A | 1/2004 |
| JP | 2006-179554 | A | 7/2006 |

* cited by examiner

*Primary Examiner* — Quan-Zhen Wang
*Assistant Examiner* — Calvin C Ma
(74) *Attorney, Agent, or Firm* — Taft Stettinius & Hollister LLP

(57) ABSTRACT

A display driving device includes an output circuit that drives display elements. The output circuit includes a bias circuit, an amplifier stage and an output stage. The bias circuit generates bias signals that include constant-current-control signals of a first bias signal and a second bias signal of the same polarity. The first and second bias signals are short circuited by a vertical line in the bias circuit and the vertical line is shielded. The amplifier stage is formed in a first well and constant-current-controlled by the first bias signal to amplify an input display signal. The output stage is formed in a second well. The first and second wells are formed separately in a semiconductor substrate. The output stage is constant-current-controlled by the second bias signal and supplies an output signal of the amplifier stage to the display element.

18 Claims, 8 Drawing Sheets

DISPLAY DRIVING DEVICE, SEMICONDUCTOR DEVICE AND LIQUID CRYSTAL DISPLAY APPARATUS

CROSS-REFERENCE TO RELATED APPLICATIONS

This application claims priority under 35 U.S.C. §119 from Japanese Patent Application No. 2008-201441 filed on Aug. 5, 2008, the disclosure of which is incorporated by reference herein.

RELATED ART

1. Field of the Invention

The present disclosure relates to a display drive device for driving a display device, such as a liquid crystal display (referred to below as "LCD"), a semiconductor device including the display drive device and a liquid crystal display apparatus including the display drive device, and more particularly, to a wiring layout for a bias signal that is a constant current control signal of a source-use amplifier circuit (referred to below as "amplifier") in a TFT source driver for driving, for example, an LCD using thin film transistors (referred to below as "TFT" and "TFT-LCD").

2. Description of the Related Art

Existing technology relating to TFT-LCD's using active matrix driving is, for example, described in Japanese Patent Application Laid-Open (JP-A) No. 2004-29409, and technology related to shield lines for suppressing cross-talk that occurs between plural signal lines provided therein is described in JP-A No. 2006-179554.

Referring to FIG. 7, which is a schematic configuration diagram showing a TFT-LCD that is an example of an existing display device, this TFT-LCD is equipped with a liquid crystal (referred to below as "LC") panel 1, a semiconductor integrated circuit (referred to below as "IC") 2 at a scanning side for gate driving, an IC 3 at a display data DIN-side for source driving, etc. The LC panel 1 is of a construction having a transparent TFT-side substrate disposed with pixel electrodes and TFT's with switching functionality, a transparent facing electrode-side substrate formed with a single facing electrode over the entire face thereof, with the two substrates set facing each other with LC filled and sealed therebetween, while the construction is not shown in the drawings. When a specific common voltage Vcom is supplied to the facing electrode and a specific voltage is applied to each of the pixel electrodes by controlling the TFT's, the transmissivity of the LC is changed by the potential difference between each of the pixel electrodes and the facing electrode, such that an image is displayed.

In order to display an image with intermediate gradations (gradated display), a variable gradated voltage is applied as the specific voltage to each of the pixel electrodes. Source lines for transmitting the gradated voltage for application to each of the pixel electrodes, and scan lines for transmitting a switching control signal (scan signal) for the TFT's, are laid down on the TFT-side substrate. The plural source lines are connected to the output side of the source driving IC 3, and the plural scan lines are connected to the output side of the gate driving IC 2.

When a clock signal CK or the like is supplied from a non-illustrated control circuit to the gate driving IC 2, and a timing signal of the clock signal CK or the like and display data DIN or the like is supplied from the control circuit to the source driving IC 3, the TFT-LCD of FIG. 7 operates in the following manner.

First, a scan signal of pulse form is transmitted from the gate driving IC 2 to each of the scan lines. When the scan signal applied to a scan line is at a high level (referred to below as "H level"), the TFT's connected to this scan line all adopt an ON state. When this occurs, the gradated voltages transmitted from the source driving IC 3 to the source lines are applied to the pixel electrodes through the TFT's that are in the ON state. Then, when the scan signal becomes at a low level (referred to below as "L level"), the TFT's are changed to the OFF state, the potential differences between the pixel electrodes and the facing electrode are maintained as they are until the next gradated voltages are applied to the pixel electrodes. By sequentially transmitting scan signals to each of the scan lines, specific gradated voltages are applied to all of the pixel electrodes, and an image can be displayed on the LC panel 1 by overwriting the gradated voltages at frame cycles.

When each of the pixel electrodes are driven by the source driving IC 3, alternating current driving is required for the potential of the facing electrode due to the particular characteristics of an LC. Typical of such alternating current driving methods are line inversion driving methods and dot inversion driving methods. A line inversion driving method is a method in which the gradated voltage from the source driving IC 3 is switched, in units of a single scan line, from a positive voltage to a negative voltage with respect to a common voltage Vcom for each period of driving a single scan line (referred to below as "horizontal period"). In contrast to this, a dot inversion driving method is a method in which switching is made by units of a single pixel electrode.

Namely, a line inversion driving method is a method for alternating current driving in which the gradated voltage from the source driving IC 3 is set, for example, at a low voltage of +5V or less, and polarities are inverted by changing the common voltage Vcom each single horizontal period. In contrast to this, a dot inversion driving method is a method in which a common voltage Vcom is fixed at a constant voltage, and voltages of positive (P) polarity (referred to below as "positive polarity gradated voltage") and voltages of negative (N) polarity (referred to below as "negative polarity gradated voltage") are set as the gradated voltage from the source driving IC 3, so as to be respectively symmetrical to each other with respect to the common voltage Vcom. The positive polarity gradated voltage and the negative polarity gradated voltage are supplied alternately for each single horizontal period. For example, in 64 gradation display, Vcom<VP 64< . . . <VP 1 are set as the positive polarity gradated voltages VP 1 to VP 64, Vcom>VN 64> . . . >VN 1 are set as the negative polarity gradated voltages VN 1 to VN 64, such that the positive polarity gradated voltages VP 1 to VP 64 and the negative polarity gradated voltages VN 1 to VN 64 are respectively symmetrical to each other with respect to the common voltage Vcom. Then one of the positive polarity gradated voltages VP 1 to VP 64, a gradated voltage VPx, and one of the negative polarity gradated voltages VN 1 to VN 64, a gradated voltage VNx, are supplied alternately for each single horizontal period.

In the TFT-LCD of FIG. 7, for example, the source driving IC 3 utilizing a dot inversion driving method: receives the display data DIN and synchronizes it with a strobe signal STB and holds; selects, from the plural gradated voltages generated internally, the gradated voltage that corresponds to the held display data DIN; converts into an analogue signal and generates gradated voltages VPx, VNx; drives the gradated voltages VPx, VNx and outputs them to each of the source lines in synchronization with the strobe signal STB using an output circuit.

Referring to FIG. 8, which is a schematic configuration diagram showing the output circuit in the source driving IC 3 of FIG. 7, the output circuit has a bias circuit 10 that is disposed in the center of the output circuit and that generates a bias signal VBH on the H side and a bias signal VBL on the L side, and plural (for example several hundred) source-side amplifier circuits (referred to below as "source amplifiers") 20, disposed on the left and right of the bias circuit 10, each forms a cell structure, for amplifying the respective input gradated voltages VPx, VNx by making respective constant currents flow with the bias signals VBH, VBL.

Horizontal lines, of a P side bias signal (VBH) line 11P and an N side bias signal (VBL) line 11N, are disposed at the top and bottom, and to the left and right, of the bias circuit 10, and the bias circuit 10 and each source amplifier 20 of the cell structure are electrically connected by these bias signal lines 11P, 11N. Since the output signal fluctuates depending on the precision of the bias signals VBH, VBL, generally, as described in JP-A No. 2006-179554, shield lines 12P, 12N are respectively provided alongside the P side bias signal lines 11P and the N side bias signal lines 11N, in order to prevent delay fluctuations of signal transmission and malfunction etc. due to the influence of cross-talk noise between signal lines. Namely, the VDD shield line 12P applied with a source voltage (referred to below as "VDD") is provided alongside the P side bias signal line 11P, and VSS shield line 12N held at ground voltage (referred to below as "VSS") is also provided alongside the N side bias signal line 11N.

The source amplifier 20 of each cell is configured by a P side source amplifier portion 20P that is connected to the P side bias signal line 11P, and by an N side source amplifier portion 20N that is connected to the N side bias signal line 11N. The P side source amplifier portion 20P has: a P side differential stage 21P that is connected to the P side bias signal line 11P, is constant-current-controlled by the P side bias signal VBH, and amplifies the input gradated voltage VPx; and a P side output stage 22P that is connected to the P side differential stage 21P via a vertical line 23P, is constant-current-controlled by the P side bias signal VBH, and drives by supplying the output signal of the P side differential stage 21P to the source line. The N side source amplifier portion 20N has: an N side differential stage 21N that is connected to the N side bias signal line 11N, is constant-current-controlled by the N side bias signal VBL, and amplifies the input gradated voltage VNx; and an N side output stage 22N that is connected to the N side differential stage 21N via a vertical line 23N, is constant-current-controlled by the N side bias signal VBL, and drives by supplying the output signal of the N side differential stage 21N to the source line.

In the output circuit configured in this manner, the bias signals VBH, VBL generated by the bias circuit 10 are respectively supplied, via P side bias signal line 11P and the N side bias signal line 11N, to the source amplifier 20 of each of the cells, and the VDD, VSS and strobe signal STB are supplied to the source amplifier 20 of each of the cells. Each of the source amplifiers 20 drives the input gradated voltages VPx, VNx, synchronizing with the strobe signal STB, and outputs them to each of the source lines.

Recently, in order to improve the precision of the source amplifiers 20 used for output, technology is being investigated for forming transistors configuring the differential stages 21P, 21N, and transistors configuring the output stages 22P, 22N, in the source amplifiers 20, in separate semiconductor wells, in order to reduce the influence on each other. When the differential stages 21P, 21N, and the output stages 22P, 22N are formed in separate wells, the bias signals VBH, VBL must be supplied to each well, and must be supplied from the bias signal lines 11P, 11N that are disposed in the horizontal direction of the output circuit and via the vertical lines 23P, 23N. For example, if one bias signal VBH (VBL) in the source amplifier 20 is a transistor gate signal of plural MOS transistors having different power sources (with the same potential but with a difference between the differential stage 21P (21N) of the source amplifier 20 and the output stage 22P (22N) thereof), then the vertical line 23P (23N) for the bias signal VBH (VBL) must be provided within the source amplifier 20. This leads to the situation in which, in each of the source amplifiers 20, with the vertical lines 23P, 23N being provided that are the bias signal lines in the vertical direction, shield lines must also be added in accordance therewith.

However, in existing technology, with the reduction in chip size there is little room for additional wiring regions, and particularly for vertical lines 23P, 23N (namely due to the cell width being narrow and densely packed with other lines), therefore placement of shield lines for the vertical lines 23P, 23N is problematic. When design is made without shield lines, then delay time in the output of the source amplifier 20 increases greatly, and it is difficult to maintain display quality. For example, when bias signals in the source amplifier 20 are not shielded, then a coupling capacity of several fF is associated between one bias signal and another signal, and overall this becomes a coupling capacity of several pF (the amount for the total number of source amplifiers). When the another signal, which is subject to coupling with the bias signals VBH, VBL, is a digital signal which frequently fluctuates, then as a result of the influence of the signal the bias signals VBH, VBL become unstable, output delay time of the source amplifiers 20 greatly increases, and display quality deteriorates.

In addition, when redesign is undertaken to lay down shield lines, this leads to a dramatic increase in man hours, and can lead to an increase in the chip size.

INTRODUCTION TO THE INVENTION

According to a first aspect of the present disclosure, there is provided a display driving device, comprising an output circuit that drives a plurality of display elements, wherein the output circuit comprises:

a bias circuit that generates a plurality of bias signals that include constant-current-control signals of a first bias signal and a second bias signal of the same polarity, the first bias signal and the second bias signal being short circuited by a vertical line in the bias circuit and the vertical line being shielded;

an amplifier stage that is formed in a first well and that is constant-current-controlled by the first bias signal to amplify an input display signal; and an output stage that is formed in a second well, the first well and the second well being formed separately in a semiconductor substrate, the output stage being constant-current-controlled by the second bias signal, and the output stage supplying an output signal of the amplifier stage to one of the plurality of display elements.

According to a second aspect of the present disclosure, there is provided a display driving device, comprising:

a bias circuit that generates a bias signal;

a plurality of amplifier stages;

a plurality of output stages respectively connected to the plurality of amplifier stages;

a first bias signal line connected to the bias circuit and the plurality of amplifier stages;

a second bias signal line connected to the bias circuit and the plurality of output stages; and a short circuit line disposed in the bias circuit and short-cutting the first bias signal line and the second bias signal line, wherein:

the short circuit line is shielded;

the plurality of amplifier stages are controlled by the bias signal supplied from the bias circuit via the first bias signal line to respectively amplify input display signals respectively supplied to the amplifier stages; and the plurality of output stages are controlled by the bias signal supplied from the bias circuit via the second bias signal line to respectively supply output signals of the plurality of amplifier stages to a plurality of display elements.

BRIEF DESCRIPTION OF THE DRAWINGS

Exemplary embodiments of the present disclosure will be described in detail based on the following figures, wherein.

DETAILED DESCRIPTION

The exemplary embodiments of the present disclosure are described and illustrated below to encompass display drive devices, devices incorporating display drive devices, and methods of fabricating the foregoing devices. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present disclosure. It should be noted that the drawings are solely for description and are not to limit the technical scope of the present invention.

Figure 1:
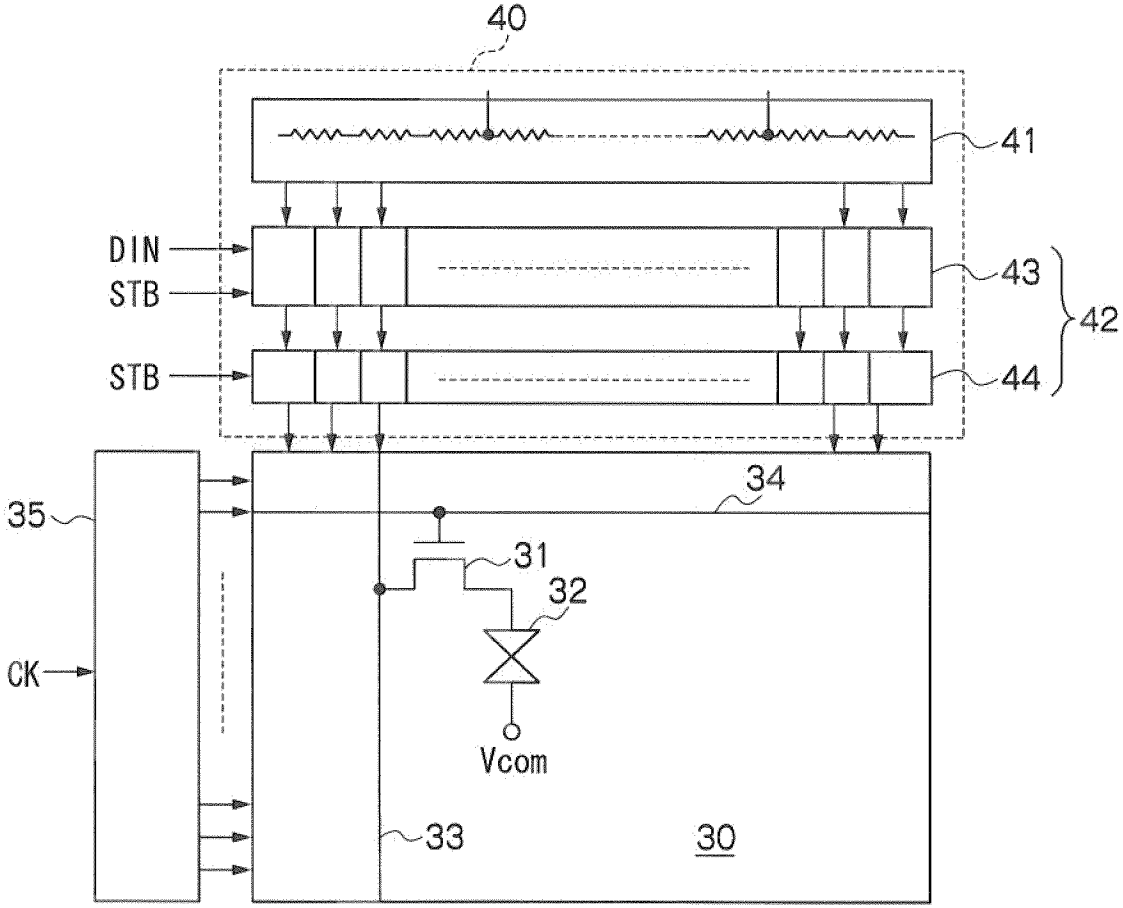
FIG. 1 is a schematic configuration diagram showing a TFT-LCD that is an example of a display device of a first exemplary embodiment of the present disclosure.

Referring to FIG. 1, a TFT-LCD 100 is equipped with an LC panel 30, an IC 35 at a scan-side for gate driving, an IC 40 at s display data DIN-side for source driving, etc.

Figure 7:
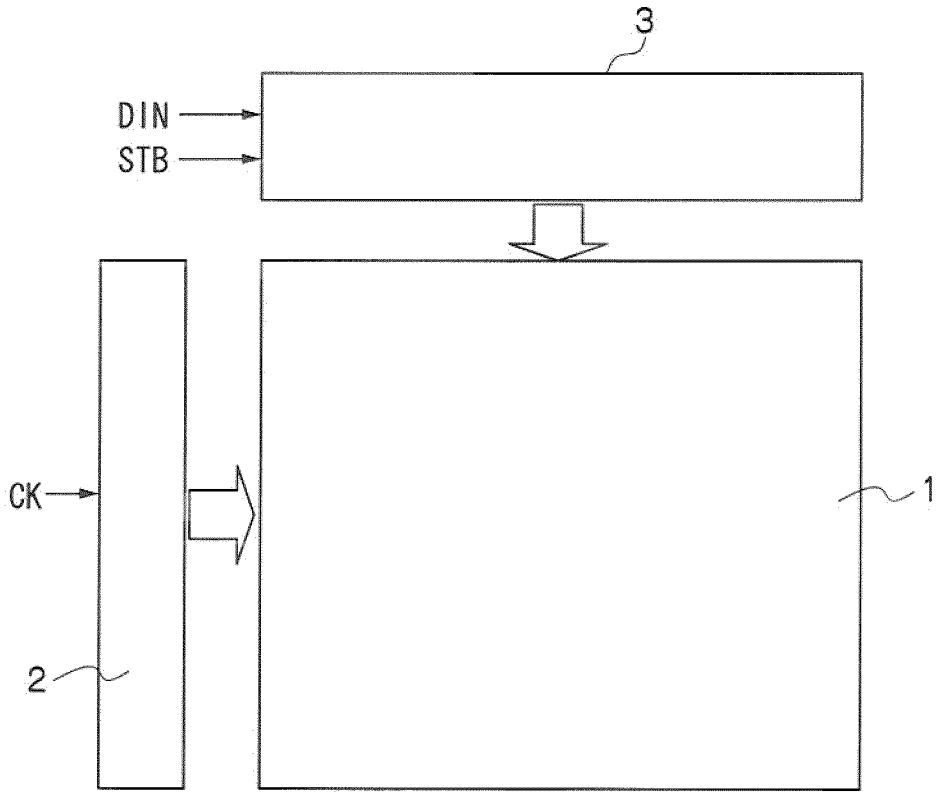
FIG. 7 is a schematic configuration diagram showing a TFT-LCD that is an example of an existing display device.

The LC panel 30 is, in a similar manner to the existing technology shown in FIG. 7, constructed with a transparent TFT-side substrate disposed with pixel electrodes and TFT's 31 with switching functionality, a transparent facing electrode-side substrate formed with a single facing electrode over the entire face thereof, with these two substrates set so as to face each other with LC 32 filled and sealed therebetween. When a specific common voltage Vcom is supplied to the facing electrode, and when a specific voltage is applied to each of the pixel electrodes by control of the TFT's 31, the transmissivity of the LC 32 is changed by the potential difference between each of the pixel electrodes and the facing electrode, such that an image is displayed.

In order to display the image in a gradated display, variable gradated voltages VPx, VNx are applied as the specific voltage to each of the pixel electrodes. Source lines 33 for transmitting the gradated voltage for application to each of the pixel electrodes, and scan lines 34 for transmitting the switching control signal (scan signal) of the TFT's 31, are laid down on the TFT side substrate. The source lines 33 are connected to the output side of the source driving IC 40, and The scan lines 34 are connected to the output side of the gate driving IC 35. Note that a power source circuit is connected to the facing electrode in order to supply the common voltage Vcom.

The source driving IC 40 is, for example, configured to use a dot inversion driving method, and includes a gradated voltage generating circuit 41 for generating plural gradated voltages, a driver cell 42 connected to the output side of the gradated voltage generating circuit 41, etc. The driver cell 42 is configured to include a D/A converter 43, an output circuit 44, etc. The D/A converter 43 is a circuit that receives the display data DIN, holds the display data DIN in synchronization with the strobe signal STB, selects from the plural generated gradated voltages the gradated voltage that accords to the held display data DIN, and converts it into an analogue signal and outputs the gradated voltages VPx, VNx. The output circuit 44 is a circuit that drives the gradated voltages VPx, VNx output from the D/A converter 43, and outputs to each of the source lines 33 in synchronization with the strobe signal STB.

Explanation will now be given of an outline of the operation of the TFT-LCD 100 configured in this manner.

For example, a clock signal CK or the like is supplied from a non-illustrated control circuit to the gate driving IC 35, and a timing signal, such as the clock signal CK, display data DIN and the strobe signal STB etc. are supplied from the control circuit to the source driving IC 40. When this occurs, a scan signal of pulse form is transmitted from the gate driving IC 35 to each of the scan lines 34. At the same time, in the source driving IC 40, plural gradated voltages are generated from the gradated voltage generating circuit 41, and supplied to the digital/analogue converter (referred to below as "D/A converter") 43. The D/A converter 43 receives the display data DIN, holds the display data DIN in synchronization with the strobe signal STB, selects, from the plural gradated voltages, the gradated voltage that accords to the held display data DIN, converts it into an analogue signal and outputs the gradated voltages VPx, VNx. The output circuit 44 thereby drives the gradated voltages VPx, VNx output from the D/A converter 43, and outputs to each of the source lines 33 in synchronization with the strobe signal STB.

When the scan signal applied to a scan line 34 is at H level, the TFT's 31 connected to the scan line 34 all adopt an ON state. When this occurs, the gradated voltages VPx, VNx transmitted from the source driving IC 40 to the source line 33 are applied to the pixel electrodes through the TFT's 31 that are in the ON state. At the same time, the common voltage Vcom is supplied from the non-illustrated control circuit to the facing electrode. Then, when the scan signal becomes at L level, the TFT's 31 are changed to the OFF state, the potential differences between the pixel electrodes and the facing electrode are maintained as they are until the next gradated voltages VPx, VNx are applied to the pixel electrodes. By sequentially transmitting scan signals to each of the scan lines 34, specific gradated voltages VPx, VNx are applied to all of the pixel electrodes, and an image is displayed on the LC panel 30 by overwriting the gradated voltages VPx, VNx at frame cycles.

Figure 2:
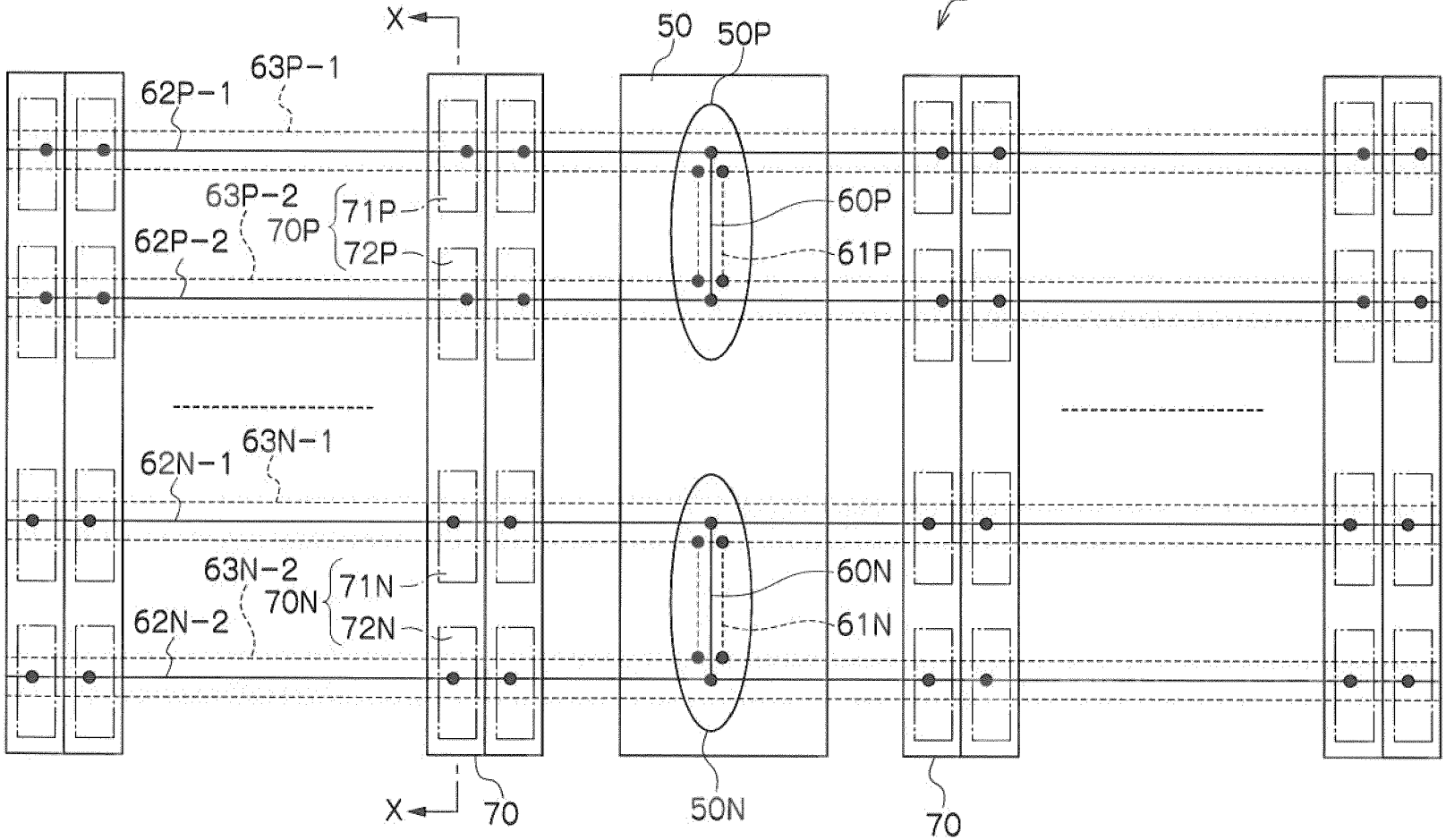
FIG. 2 is a schematic configuration diagram showing an output circuit 44 in the TFT-LCD of FIG. 1 in the first exemplary embodiment of the present disclosure.

Referring to FIG. 2, the output circuit 44 includes: a bias circuit 50, disposed at the center of the output circuit 44 and generating an H side bias signal VBH and an L side bias signal VBL; and, disposed to the left and right of the bias circuit 50, plural (for example several hundred individual) source amplifiers 70, respectively forming cell structures for flowing respective constant currents depending on the bias signals VBH, VBL and amplifying the respective input gradated voltages VPx, VNx.

The bias circuit 50 is configured with a P side bias circuit section 50P for generating the H side bias signal VBH, and with an N side bias circuit section 50N for generating the L side bias signal VBL.

The P side bias circuit section 50P is configured to include a vertical line 60P for short circuiting use, and to output the P side bias signal VBH from both respective ends of the vertical line 60P. A VDD shield line 61P to which VDD is applied is provided alongside the vertical line 60P. A P side bias signal (VBH) line 62P-1, which is a horizontal line extending in the horizontal direction, is connected to a portion at one end of the vertical line 60P. A P side bias signal (VBH) line 62P-2, which is a horizontal line extending in the horizontal direction, is also connected to a portion at the other end of the vertical line 60P. A VDD shield line 63P-1 is provided alongside the P side bias signal line 62P-1 and a VDD shield line 63P-2 is also provided alongside the P side bias signal line 62P-2.

Similarly, the N side bias circuit section 50N is configured to include a vertical line 60N for short circuiting use, and to output the N side bias signal VBL from both respective ends of the vertical line 60N. A VSS shield line 61N which is held at VSS is provided alongside the vertical line 60N. An N side bias signal (VBL) line 62N-1, which is a horizontal line extending in the horizontal direction, is connected to a portion at one end of the vertical line 60N. An N side bias signal (VBL) line 62L-2, which is a horizontal line extending in the horizontal direction, is also connected to a portion at the other end of the vertical line 60N. A VSS shield line 63N-1 is provided alongside the N side bias signal line 62L-1 and a VSS shield line 63N-2 is also provided alongside the N side bias signal line 62N-2.

The plural source amplifiers 70 each forming a cell structure are connected to the left and right portions of the P side bias signal lines 62P-1, 62P-2 and the N side bias signal lines 62N-1, 62N-2. The source amplifier 70 of each cell is configured with a P side source amplifier portion 70P connected to the P side bias signal lines 62P-1, 62P-2 and a N side source amplifier portion 70N connected to the N side bias signal lines 62N-1, 62N-2.

Figure 3:
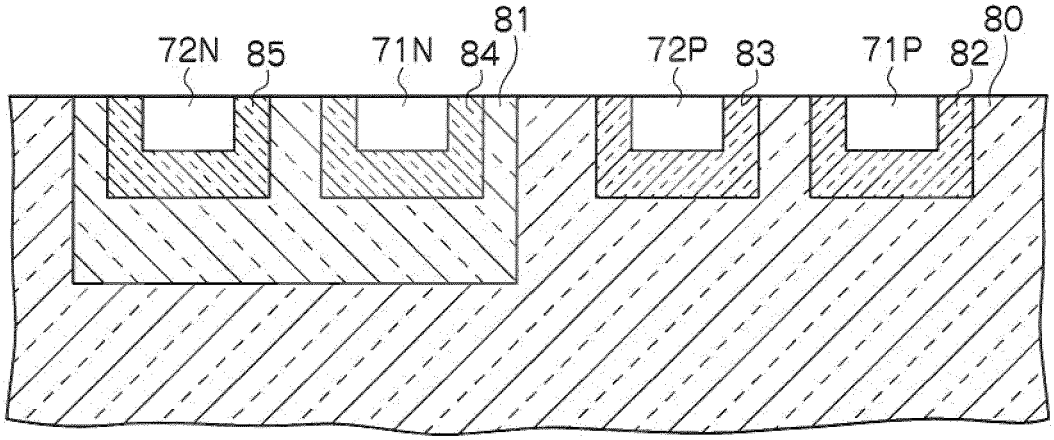
FIG. 3 is a schematic vertical sectional view taken along a line X-X.

The P side source amplifier portion 70P has a P side amplifier stage (for example a P side differential stage) 71P formed in a first well 82 (See FIG. 3), and a P side output stage 72P formed in a second well 83 (See FIG. 3). The first well 82 and the second well 83 are formed separately in a semiconductor substrate 80 (See FIG. 3). The P side differential stage 71P is a circuit connected to the P side bias signal line 62P-1, is constant-current-controlled by the P side bias signal VBH, and amplifies the input gradated voltage VPx. The P side output stage 72P is a circuit that is connected to the P side bias signal line 62P-2, is constant-current-controlled by the P side bias signal VBH, and supplies the output signal of the P side differential stage 71P to the source line 33.

The N side source amplifier portion 70N has an N side amplifier stage (for example a N side differential stage) 71N formed in a third well 84 (See FIG. 3), and an N side output stage 72N formed in a fourth well 85 (See FIG. 3). The third well and the fourth well are formed separately in the semiconductor substrate 80 (See FIG. 3). The N side differential stage 71N is a circuit connected to the N side bias signal line 62N-1, is constant-current-controlled by the N side bias signal VBL, and amplifies the input gradated voltage VNx. The N side output stage 72N is a circuit that is connected to the N side bias signal line 62N-2, is constant-current-controlled by the N side bias signal VBL, and supplies the output signal of the N side differential stage 71N to the source line 33.

Referring to FIG. 3, an N-type well 82 and an N-type well 83 are formed separately in the P-type semiconductor substrate 80. The P side amplifier stage 71P is formed in the N-type well 82 and the P side output stage 72P is formed in the N-type well 83. An N-type well 81 is formed in P-type semiconductor substrate 80. A P-type well 84 and a P-type well 85 are formed separately in the N-type well 81. The N side amplifier stage 71N is formed in the P-type well 84 and the N side output stage 72N is formed in the P-type well 85.

Figure 4:
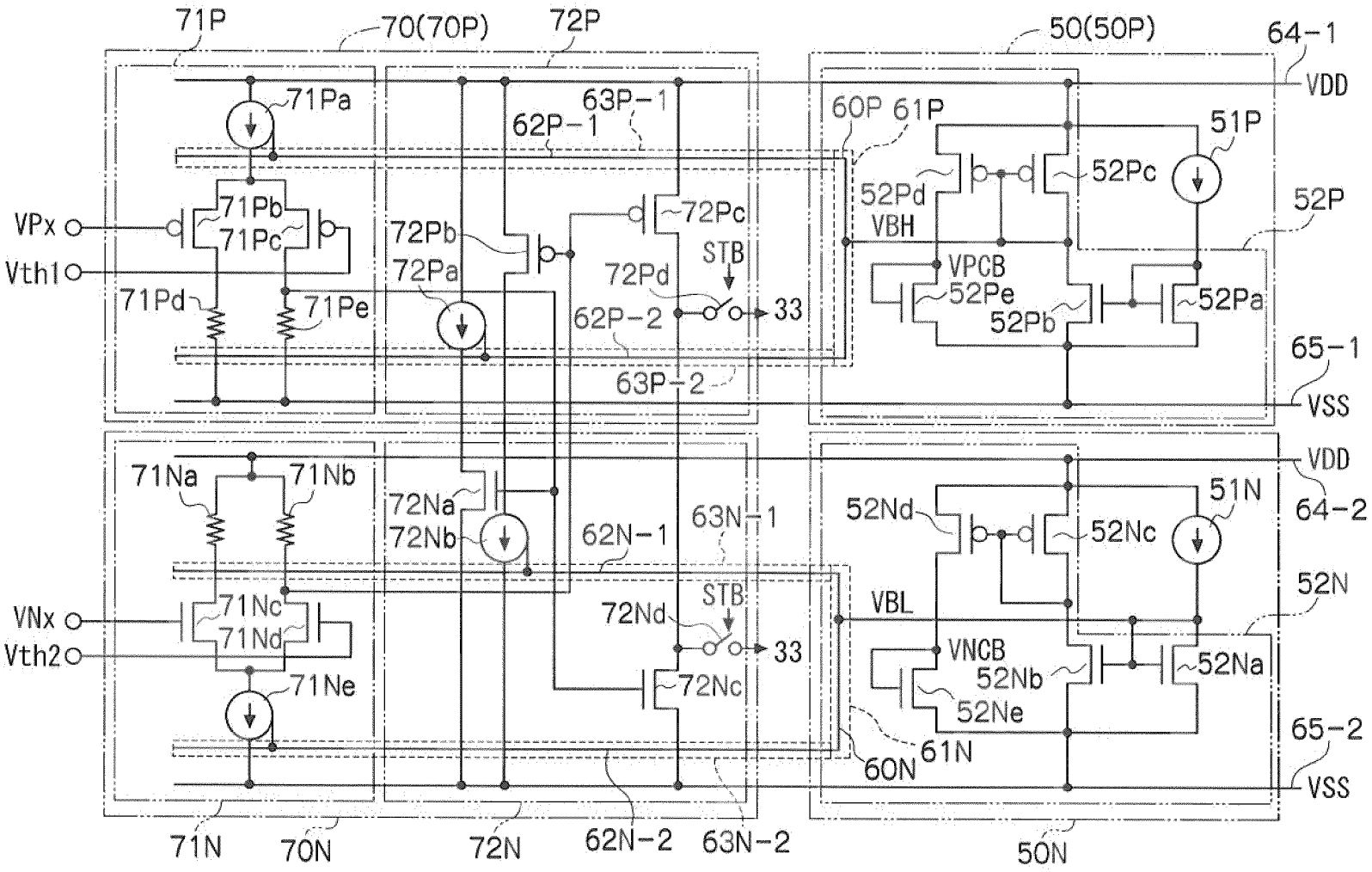
FIG. 4 is a circuit diagram showing a portion of an exemplary circuit configuration in the output circuit 44 of FIG. 2.

Referring to FIG. 4, the bias circuit 50 and the source amplifier 70 of one of the cells connected thereto, are shown. The bias circuit 50 and the source amplifier 70 are configured so as to be supplied with source power by horizontal lines of VDD lines 64-1, 64-2 and VSS lines 65-1, 65-2.

The bias circuit 50 is configured by the P side bias circuit portion 50P and the N side bias circuit portion 50N. The P side bias circuit portion 50P is connected to the VDD line 64-1 and is configured by a bias current source 51P for generating a bias current and a bias signal extraction portion 52P that extracts the bias current in the form of the bias signal VBH. The bias signal extraction portion 52P is connected between the output side of the bias current source 51P and the VSS line 65-1, and is configured with: a first current mirror circuit formed from two N channel MOS transistors (referred to below as "NMOS") 52Pa, 52Pb; a second current mirror circuit, connected between the first current mirror circuit and the VDD line 64-1, formed from two P channel MOS transistors (referred to below as "PMOS") 52Pc, 52Pd for outputting the bias signal VBH that corresponds to the output current of the first current mirror circuit; an NMOS 52Pe diode-connected between the output side of the second current mirror circuit and the VSS line 65-1; etc. The voltage at the connection point between the PMOS 52Pd and NMOS 52Pe is VPCB.

The N side bias circuit portion 50N is connected to the VDD line 64-2 and is configured by a bias current source 51N for generating a bias current and a bias signal extraction portion 52N that extracts the bias current in the form of the bias signal VBL. The bias signal extraction portion 52N is connected between the output side of the bias current source 51N and the VSS line 65-2, and is configured with: a third current mirror circuit formed from two NMOS's 52Na, 52Nb for outputting the bias signal VBL that corresponds to the bias current of the bias current source 51N; a fourth current mirror circuit, connected between the third current mirror circuit and the VDD line 64-2, formed from two PMOS's 52Nc, 52Nd for making a current flow that corresponds to the output current of the third current mirror circuit; an NMOS 52Ne diode-connected between the output side of the fourth current mirror circuit and the VSS line 65-2; etc. The voltage at the connection point between the PMOS 52Nd and NMOS 52Ne is VNCB.

The source amplifier 70 is configured from the P side source amplifier portion 70P and the N side source amplifier portion 70N. The P side source amplifier portion 70P is configured from: the P side differential stage 71P that amplifies the gradated voltage VPx supplied from the D/A converter 43; and the P side output stage 71P that outputs the amplified gradated voltage VPx to the source line 33 in synchronization with the strobe signal STB. In a similar manner, the N side source amplifier portion 70N is configured from: an N side differential stage 71N that amplifies the gradated voltage VNx supplied from the D/A converter 43; and an N side output stage 71N that outputs the amplified gradated voltage VNx to the source line 33 in synchronization with strobe signal STB.

The P side differential stage 71P includes, for example: a current source 71Pa that is connected to the VDD line 64-1, and controlled by the P side bias signal VBH supplied from the P side bias signal line 62P-1 to flow a constant current; a PMOS 71Pb for input, connected to the output side of the current source 71Pa and operated ON/OFF by the gradated voltage VPx; a PMOS 71Pc for input, branch connected to the output side of the current source 71Pa and operated ON/OFF by a reference voltage Vth1; a resistance element 71Pd configured by a resistance or load MOS transistor etc. and connected between the output side of the PMOS 71Pb and the VSS line 65-1; a resistance element 71Pe configured by a resistance or load MOS transistor etc. and connected between the output side of the PMOS 71Pc and the VSS line 65-1.

The P side output stage 72P includes: a current source 72Pa that is connected to the VDD line 64-1, and controlled by the P side bias signal VBH supplied from the P side bias signal Line 62P-2 to flow a constant current to the N side output stage 72N; a PMOS 72Pb that is connected to the VDD line 64-1, and operated ON/OFF by the output voltage of the N side differential stage 71N to let a constant current pass or to interrupt the constant current to the N side output stage 72N; a PMOS 72Pc that is connected to the VDD line 64-1, and operated ON/OFF by the output voltage of the N side differential stage 71N to let power source current from the VDD line 64-1 pass or to interrupt the power source current; an output switch 72Pd that is connected to the output side of the PMOS 72Pc, and operated ON/OFF by the strobe signal STB to output the amplified gradated voltage VPx to the source line 33; etc.

The N side differential stage 71N includes, for example: resistance elements 71Na, 71Nb configured from resistances or load MOS transistors etc. and connected to the VDD line 64-2; an NMOS 71Nc for input use, connected to the resistance element 71Na and operated ON/OFF by the gradated voltage VNx; an NMOS 71Nd for input use, connected to the resistance element 71Nb and operated ON/OFF by a reference voltage Vth2; a current source 71Ne that is connected between the NMOS 71Nc, 71Nd and the VSS line 65-2, and controlled by the N side bias signal VBL supplied from the N side bias signal line 62N-2 to flow a constant current; etc.

The N side output stage 72N includes: a PMOS 72Na that is connected to the VSS line 65-2, and operated ON/OFF by the output voltage of the P side differential stage 71P to let a constant current from the current source 71Pa pass or to interrupt the constant current; a current source 72Nb that is connected to the VSS line 65-2, and controlled by the N side bias signal VBL supplied from the N side bias signal line 62N-1 to flow constant current for the PMOS 72Pb; an NMOS 72Nc that is connected to the VSS line 65-2, and operated ON/OFF by the output voltage of the P side differential stage 71P to let power source current flowing to the VSS line 65-2 pass or to interrupt the power source current; an output switch 72Nd that is connected to the output side of the NMOS 72Nc, and operated ON/OFF by the strobe signal STB to output the amplified gradated voltage VNx to the source line 33.

Explanation will now be given of the operation of the output circuit 44, with reference to FIG. 1 and FIG. 3.

First, constant bias currents are generated in the bias circuit 50 using respective bias current sources 51P, 51N, the P side bias signal VBH and the N side bias signal VBL that correspond to these bias currents are extracted by the respective bias signal extraction portions 52P, 52N. The extracted P side bias signal VBH is supplied, via the P side vertical line 60P and the P side bias signal lines 62P-1, 62P-2, to the P side source amplifier portion 70P in the source amplifier 70 of each of the cells. In a similar manner, the extracted N side bias signal VBL is also supplied, via the N side vertical line 60N and the N side bias signal lines 62N-1, 62N-2, to the N side source amplifier portion 70N in the source amplifier 70 of each of the cells. When this occurs, the VDD of the VDD lines 64-1, 64-2, the VSS of the VSS lines 65-1, 65-2, and the strobe signal STB, are supplied to the source amplifier source amplifier 70 of each of the cells.

The P side source amplifier portion 70P and the N side source amplifier portion 70N in each of the source amplifiers 70 then operate in the following manner. In the P side source amplifier portion 70P, the current sources 71Pa, 72Pa are controlled by the bias signal VBH, flowing a constant current, the gradated voltage VPx is amplified using the P side differential stage 71P, the amplified gradated voltage VPx is output, in synchronization with the strobe signal STB, to each of the source lines 33 from the output switch 72Pd of the P side output stage 72P. In a similar manner, in the N side source amplifier portion 70N, the current sources 71Ne, 72Nb are controlled by the bias signal VBL, flowing a constant current, the gradated voltage VNx is amplified using the N side differential stage 71N, the amplified gradated voltage VNx is output, in synchronization with the strobe signal STB, to each of the source lines 33 from the output switch 72Nd of the N side output stage 72N.

The specific gradated voltages VPx, VNx are applied to all of the pixel electrodes by scan signals sequentially transmitted from the gate driving IC 35 to each of the scan lines 34, and a given image etc. is displayed on the LC panel 30 by overwriting the gradated voltages VPx, VNx at frame cycles.

Figure 8:
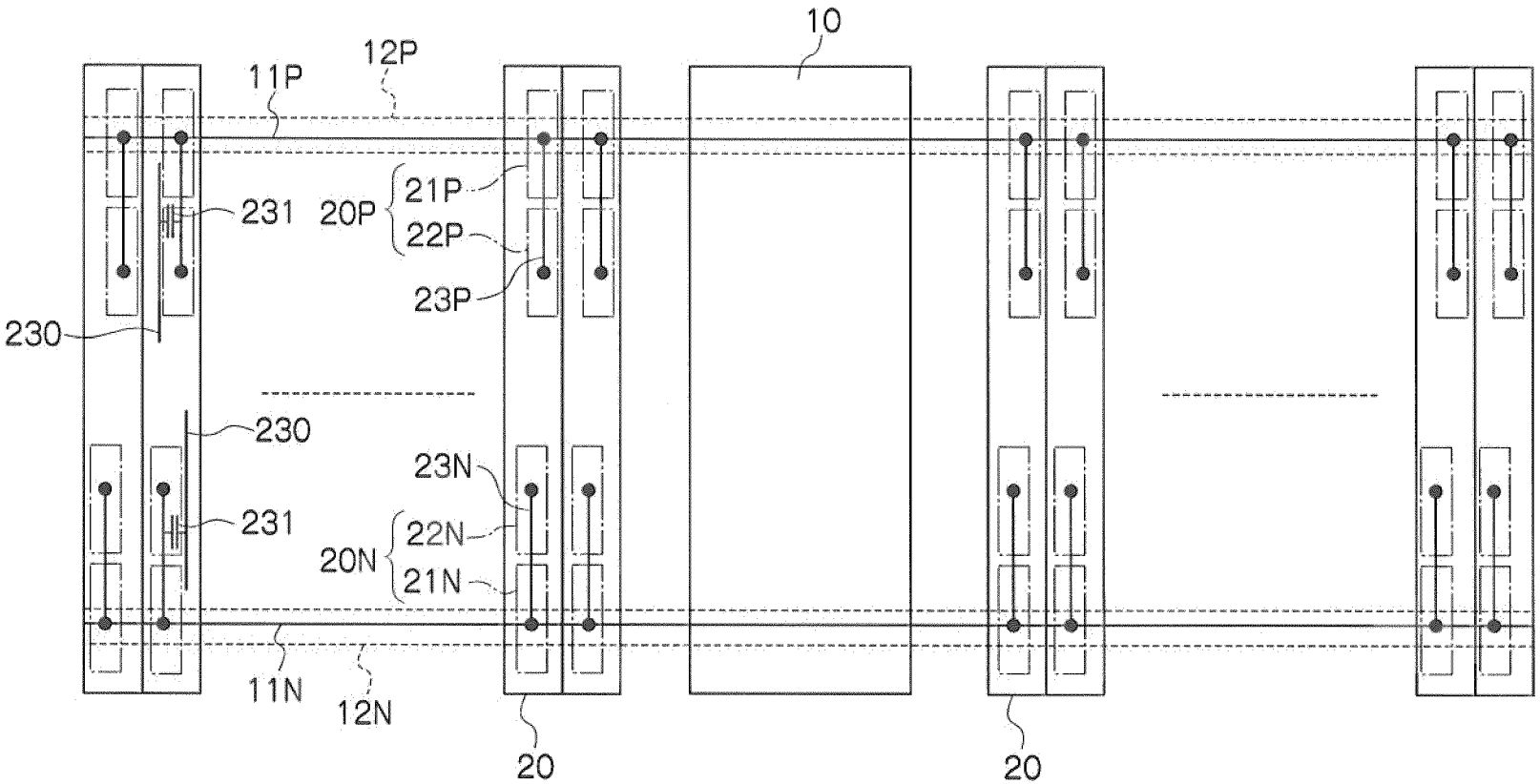
FIG. 8 is a schematic configuration diagram showing the output circuit in the source driving-use IC 3 of FIG. 7.

In the first exemplary embodiment as shown in FIG. 2 and FIG. 4, the vertical lines 23P, 23N are not provided of the source amplifier 20 for the bias signals VBH, VBL of existing technology shown in FIG. 8, and, instead, the respective bias signals VBH, VBL are supplied from the bias circuit 50 to the differential stages 71P, 71N and output stages 72P, 72N of separate wells, the bias signals VBH, VBL of the same respective polarity in the bias circuit 50 are short circuited by the vertical lines 60P, 60N in the bias circuit 50, and shielding is also performed by providing the shield lines 61P, 61N alongside these vertical lines 60P, 60N. By not providing the vertical lines 23P, 23N of the existing source amplifier 20, the adjacency to other signals is removed and coupling capacity can be eliminated. Further, since the horizontal bias signal lines 62P-1, 62P-2, 62N-1, 62N-2 are provided instead of the vertical lines 23P, 23N of the existing technology, the capacities to the VDD and to the VSS increases, the bias signals VBH, VBL are further stabilized, and the output delay time of the source amplifiers 70 is lessoned as compared to previously. The source driving IC 40 of stable quality can therefore be realized at low cost.

Figure 5:
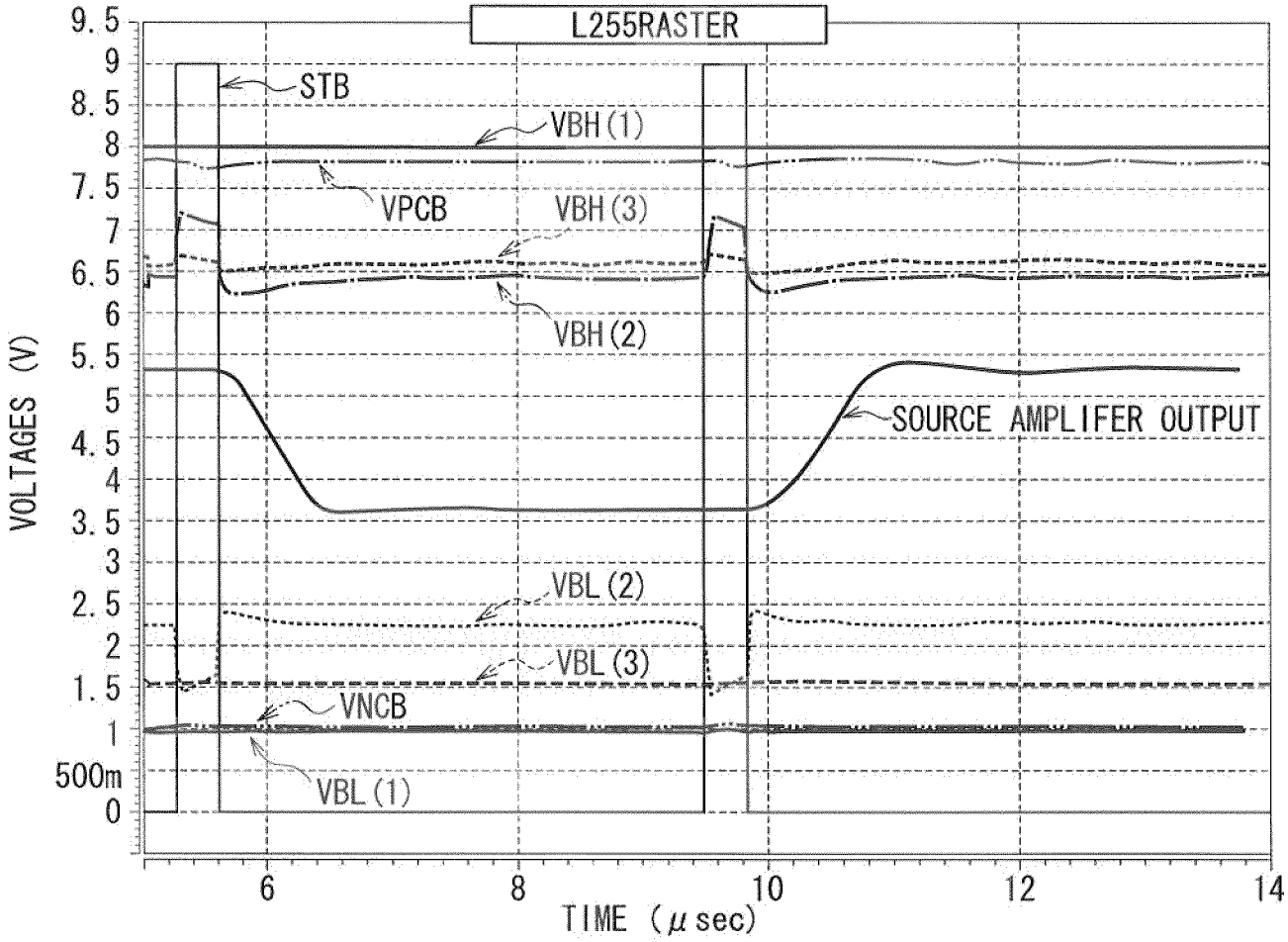
FIG. 5 is a diagram showing a simulation waveform of a source amplifier 70 wired with bias signal lines of the first exemplary embodiment of the present disclosure.
Figure 6:
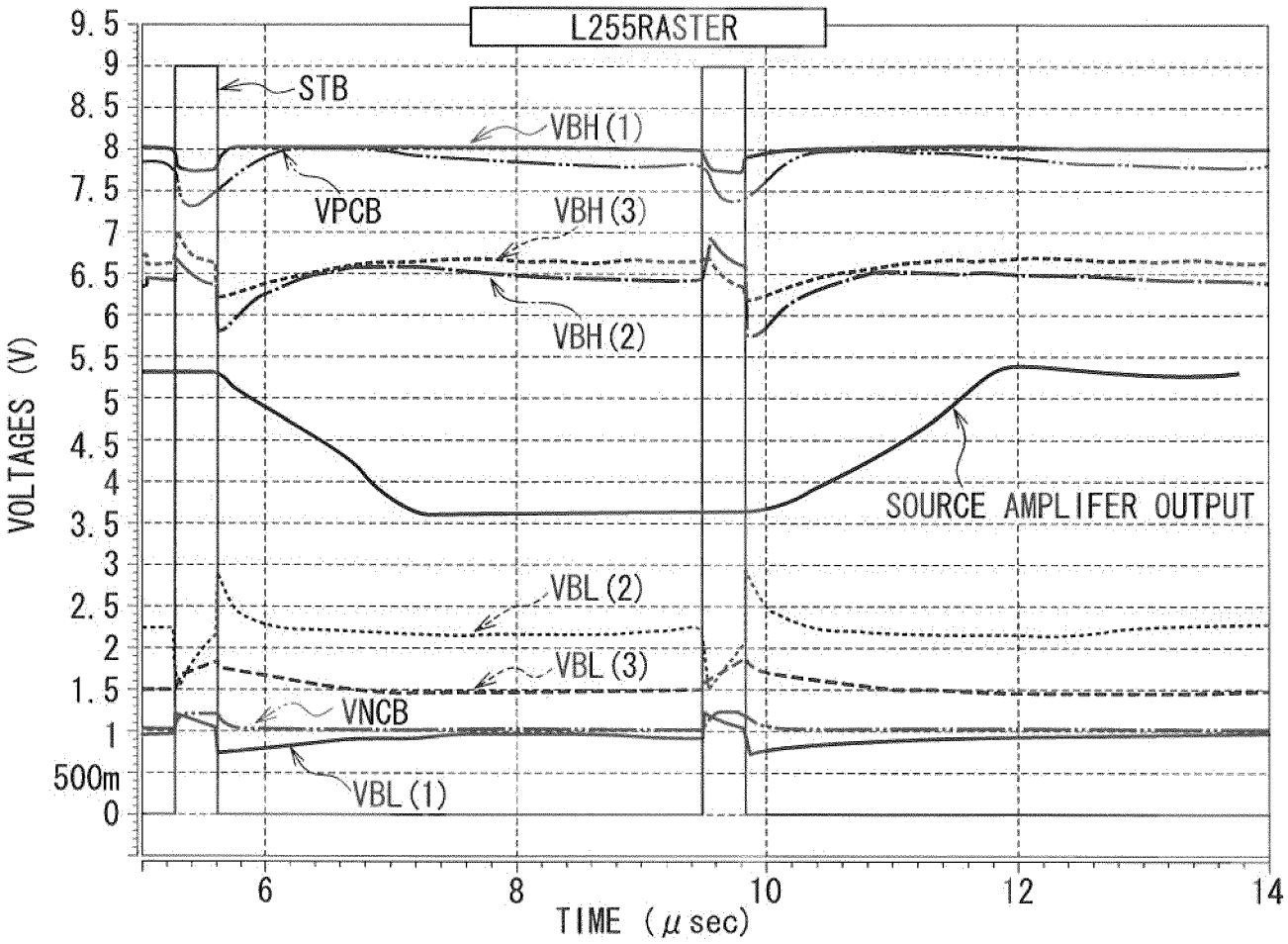
FIG. 6 corresponds to FIG. 5 and is a diagram showing a simulation waveform of a source amplifier 20 wired with bias signal lines of existing technology.

FIG. 5 is a diagram showing a simulation waveform of a source amplifier 70 with bias signal wiring of the first exemplary embodiment of the present disclosure, FIG. 6 is a diagram showing a simulation waveform of a source amplifier 20 with bias signal wiring of existing technology corresponding to FIG. 5.

In FIG. 5 and FIG. 6, the bias signals VBH (1), VBH (2), VBH (3) and bias signals VBL (1), VBL (2), VBL (3) show the results of three respective simulation runs with changed simulation conditions of the bias signals VBH, VBL. It can be seen from these results that in the first exemplary embodiment, the output delay time of the source amplifier 70 is lessoned as compared to previously.

The display device of the TFT-LCD of FIG. 1 may be changed to another circuit configuration other than the one illustrated. The present disclosure applied to a driving device used for display can be applied to another sort of display device other than a TFT-LCD.

The output circuit 44 of FIG. 2 and FIG. 4 may have a circuit configuration other than that illustrated, and the layout configuration of the signal lines may also be changed.

Following from the above description, it should be apparent to those of ordinary skill in the art that, while the methods and apparatuses herein described constitute exemplary embodiments of the present disclosure and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the disclosure in order to fall within the scope of any claims, since the invention is defined by the claims and since inherent and/or unforeseen advantages of the present invention may exist even though they may not have been explicitly discussed herein.

What is claimed is:

1. A display driving device, comprising an output circuit that drives a plurality of display elements, wherein the output circuit comprises:

a bias circuit that generates a plurality of bias signals that include constant-current-control signals of a first bias signal and a second bias signal of the same polarity, the first bias signal and the second bias signal being short circuited by a vertical line in the bias circuit and the vertical line being shielded;

an amplifier stage that is formed in a first well and that is constant-current-controlled by the first bias signal to amplify an input display signal; and an output stage that is formed in a second well, the first well and the second well being formed separately in a semiconductor substrate, the output stage being constant-current-controlled by the second bias signal, and the output stage supplying an output signal of the amplifier stage to one of the plurality of display elements.

2. The display driving device of claim 1, wherein:

the first bias signal and the second bias signal are respectively transmitted by horizontal lines; and the horizontal lines are respectively shielded.

3. The display driving device of claim 1, wherein the amplifier stage is configured from a differential stage of a differential amplifying circuit.

4. The display driving device of claim 1, wherein the output signal of the output stage is supplied to the one of the plurality of display elements via a thin film transistor that is operated ON/OFF.

5. The display driving device of claim 1, wherein each of the display elements is a liquid crystal display element.

6. The display driving device of claim 1, wherein the output circuit is an output circuit used for source driving.

7. A semiconductor device comprising the display driving device of claim 1.

8. A liquid crystal display apparatus comprising the display driving device of claim 1.

9. A display driving device, comprising:

a bias circuit that generates a bias signal;

a plurality of amplifier stages;

a plurality of output stages respectively connected to the plurality of amplifier stages;

a first bias signal line connected to the bias circuit and the plurality of amplifier stages;

a second bias signal line connected to the bias circuit and the plurality of output stages; and a short circuit line disposed in the bias circuit and short-cutting the first bias signal line and the second bias signal line, wherein:

the short circuit line is shielded;

the plurality of amplifier stages are controlled by the bias signal supplied from the bias circuit via the first bias signal line to respectively amplify input display signals respectively supplied to the amplifier stages; and the plurality of output stages are controlled by the bias signal supplied from the bias circuit via the second bias signal line to respectively supply output signals of the plurality of amplifier stages to a plurality of display elements.

10. The display driving device of claim 9, further comprising:

a semiconductor substrate;

a first well formed in the semiconductor device; and a second well formed in the semiconductor device separately from the first well, wherein the amplifier stage is formed in the first well, and the output stage is formed in the second well.

11. The display driving device of claim 9, wherein the first bias signal line and the second bias signal line are shielded.

12. The display driving device of claim 9, wherein:

the plurality of amplifier stages are constant-current-controlled by the bias signal supplied from the bias circuit via the first bias signal line; and the plurality of output stages are constant-current-controlled by the bias signal supplied from the bias circuit via the second bias signal line.

13. The display driving device of claim 9, wherein the amplifier stage is configured from a differential stage of a differential amplifying circuit.

14. The display driving device of claim 9, wherein the output signals of the output stages are respectively supplied to the display elements via thin film transistors that are operated ON/OFF.

15. The display driving device of claim 9, wherein each of the display elements is a liquid crystal display element.

16. The display driving device of claim 9, wherein the output circuit is an output circuit used for source driving.

17. A semiconductor device comprising the display driving device of claim 9.

18. A liquid crystal display apparatus comprising the display driving device of claim 9.

* * * * *